US006217256B1

(12) United States Patent
Inan

(10) Patent No.: US 6,217,256 B1
(45) Date of Patent: Apr. 17, 2001

(54) WAVE MACHINE FOR LIQUIDS

(76) Inventor: Mehmet Zahit Inan, Rue du Moulin 245, B-6061, Montignies sur Sambre (BE)

( * ) Notice: Subject to any disclaimer, the term of this patent is extended or adjusted under 35 U.S.C. 154(b) by 0 days.

(21) Appl. No.: 09/401,002

(22) Filed: Sep. 21, 1999

Related U.S. Application Data

(63) Continuation of application No. PCT/BE98/00304, filed on Apr. 3, 1998.

(30) Foreign Application Priority Data

Apr. 3, 1997 (BE) ..... 9700304

(51) Int. Cl.[7] ..... E02B 3/00; A47K 3/10
(52) U.S. Cl. ..... 405/79; 4/491; 472/128
(58) Field of Search ..... 405/79, 52, 76, 405/80; 4/491; 472/128

(56) References Cited

U.S. PATENT DOCUMENTS

| | | | | |
|---|---|---|---|---|
| 3,789,612 | * | 2/1974 | Richard et al. | 405/79 |
| 3,973,405 | * | 8/1976 | Duport | 405/79 |
| 4,276,664 | * | 7/1981 | Baker | 405/79 X |
| 4,507,018 | * | 3/1985 | Andersen | 405/79 |
| 4,705,428 | * | 11/1987 | Andersen | 405/79 |
| 4,810,129 | | 3/1989 | Guevel et al. | 405/79 |
| 5,320,449 | | 6/1994 | Demarteau | 405/79 |
| 5,621,925 | | 4/1997 | Bastenhof | 4/491 |

FOREIGN PATENT DOCUMENTS

| | | |
|---|---|---|
| 0236653 | 9/1987 | (EP) . |
| 0732468 | 9/1996 | (EP) . |
| 409236 | 5/1934 | (GB) . |
| 9114062 | 9/1991 | (WO) . |

* cited by examiner

*Primary Examiner*—Eileen D. Lillis
*Assistant Examiner*—Tara L. Mayo
(74) *Attorney, Agent, or Firm*—Ladas and Parry

(57) ABSTRACT

A device for making waves in a liquid (2) contained in a pond (1) such as a swimming pool, by the substantially vertical reciprocating motion of a body placed within the liquid or at the surface thereof. The body is a shell (3) capable of being filled with the said liquid (2). The shell (3) is connected by a linking member (4) to an element capable of periodically applying an upward-oriented force in a substantially vertical direction, then in lowering the said shell (3) again. The shell (3) preferably comprises a horizontal base and substantially vertical side walls.

21 Claims, 3 Drawing Sheets

WAVE MACHINE FOR LIQUIDS

This application is a continuation of PCT/BE98/00304 filed Apr. 3, 1998.

FIELD OF THE INVENTION

The present invention refers to a device that creates waves in a liquid, especially when this liquid is contained in a pond or a pool. Such devices are used for example in fun fairs, but also in hydraulic or naval testing ponds.

The invention also refers to a wave creation method using the said device.

BACKGROUND AND PRIOR ART

It is know from U.S. Pat. No. 3,789,612 is a method that makes waves in a volume of water.

In one of the options of this method, a massive plunger, to which a vertical reciprocating motion is applied, is used for making waves. The plunger requires significant mechanical means to move it and to guide it.

In another option of that method, an open lower end tank is used. When the tank is lifted up above the surface of the water, the water volume that it contains discharges suddenly, resulting in the creation of a disturbance. This system allows the creation of one wave, but not of a system of sustained waves.

In international application WO 91/14062 a motion generation system in a liquid is known, especially at the surface of that liquid. That system uses a device containing two elements one of which moves relatively to the other. That relative displacement creates inertial forces, which make the whole device move in the liquid. That displacement creates excitations in the liquid, which are transformed in waves. In one of the embodiments of that system, one of the elements is a hollow sphere in which the second element moves. That kind of system effectively allows making waves at the surface of a liquid. But it has several disadvantages.

In the embodiment where the device is a sphere and also in other forms, the vertical stability of the system is not satisfactory. Specially, it can turn upside down when the mobile mass is in high position with respect to the shell.

The inertia forces being proportional to the moving mass, the mass of the device must be significant to create appreciable waves. The weight of the device makes its handling difficult. Moreover, the components designed to make the relative movement of the two elements have to be dimensioned accordingly, to be able to displace that significant mass, which has an incidence on the cost.

When a mobile element is moved by a harmonic movement of fixed amplitude, for example by a crank-connected rod system, the inertia force created is proportional to the weight and to the square of the frequency of the movement. It is thus not possible to adjust that excitation force independently from the frequency, or conversely, it is not possible to modify the frequency without modifying the excitation force. At the start, it is not possible to progressively increase the excitation force before reaching normal operating conditions.

The components designed to make the relative movement are part of the device. In that way, they are under the ambient conditions of the liquid, and are subject to damage by any small tightness default of the box. Moreover, they are hardly accessible for maintenance.

In one form of embodiment of that device, the power needed to put in motion the elements of the device is transferred to the device, for example by the means of an electrical cable. That cable is moved by the repetitive movements of the device. It is subject to wear or may be broken, and represent a risk. Moreover, the presence of that cable in the liquid makes a constraint.

In another form of embodiment of that device, the power needed to put the elements of the device in motion is stored inside the device, for example by means of electric energy in a battery, or pressure energy in a tank. In that case, the periodical need of recharge is a disadvantage for its operation.

Different wave machines based on various principles, for example by the EP 0 236 653, or EP 0 732 468, are also known but all request a major adaptation of the pool. These devices are not adapted to the generation of waves in existing pools.

SUMMARY OF THE INVENTION

The present invention has precisely the aim to provide a device that has not the aforesaid disadvantages. It has the aim to provide a wave generation device for pools, that is easy to install and operate, that consumes few energy, whose components in contact with the liquid are resistant to the environment wherein they are placed, that can be placed in an existing pool without any need to change the infrastructure, and that is easily removable to leave the pool in its original state.

The invention concerns a device that makes waves in a liquid contained in a pond or a pool, by a substantially vertical reciprocating motion of a body placed within the liquid or at the surface thereof. The body used for that is a shell capable of being filled with the said liquid. The shell is connected with a linking means to an element capable of periodically applying an upward-oriented force in a substantially vertical direction, then leaving the said shell to fall down again.

The principle of the invention is to transfer energy to the liquid, in phase with the kinetic energy of the wave.

The shell contains preferably a horizontal base and substantially vertical side walls. So, in the neighborhood of the shell, the vertical movement of the liquid is favored.

To allow the shell to be filled with water when it is placed within the water, a simple hole can be added to the bottom side of the shell. The shell may contain a flotation element.

In one embodiment, the shell of the device according to the invention contains a base equipped with a plurality of holes. These holes are advantageously able to favor the penetration of the liquid into the shell, but to disfavor its exit.

In another embodiment, the shell contains a topside shaped as a dish cover, containing at least one aperture for air flow. This aperture or these apertures are advantageously able to favor the exit of the air located in the upper part of the shell, but to disfavor its penetration.

The shell can also be made combining the characteristics of both the above mentioned embodiments.

The element capable of periodically applying an upward-oriented force preferably contains a winch able to roll and unroll the linking means. That winch preferably contains a regulation control box able to adjust the rolling and unrolling period of the said winch and its motor torque.

The invention also concerns a process in which a shell is suspended above a place of the pond, the said shell being partially immersed in the said pond, and where one periodically executes the action of lifting the said shell during a given period, then leaving it to fall down again.

In that process, the period of the movements imposed to the shell is determined preferably in a way to excite one of the natural oscillation frequencies of the liquid contained in the pond, and the motor torque applied to the winch during the shell lifting in a way to obtain the wanted amplitude of the waves. The motor torque applied to the winch during the falling down of the shell is preferably determined in a way to maintain the linking means permanently under stress.

BRIEF DESCRIPTION OF THE FIGURES OF THE DRAWING

Other characteristics and advantages of the invention will appear in the following description, taken with to the appended figures.

DETAILED DESCRIPTION

Figure 1:
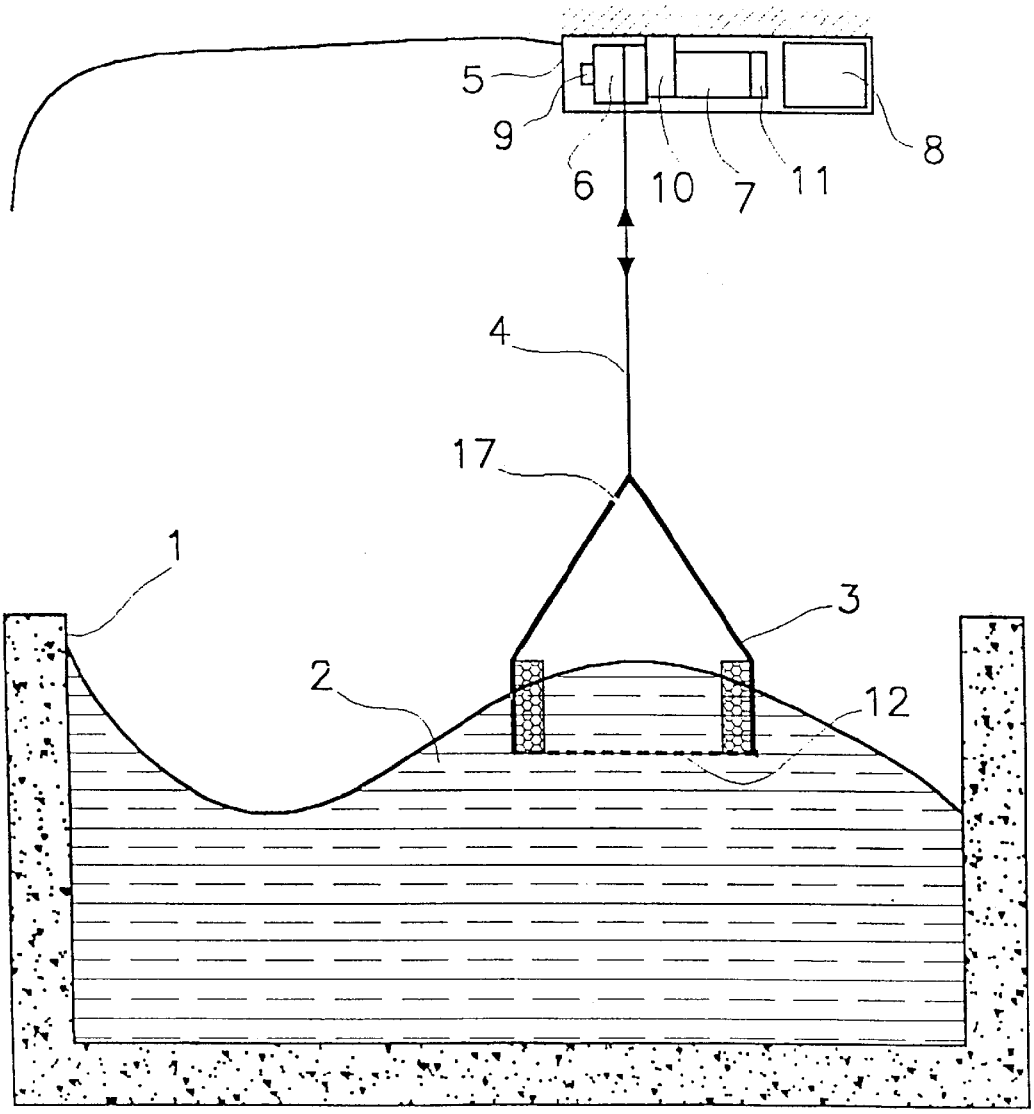
FIG. 1 is a schematic section view of a pond equipped with a device in accordance with the invention.

FIG. 1 shows a pool 1 filled with a liquid 2, such as a water filled swimming and amusement pool. The pool 1 can be rectangular or round, or any other shape. A shell 3 is suspended within the pool 1 by a linking means 4, which can be a cable, a strap, a rope or a chain forming a flexible tension member.

A winch 5 contains a drum 6 on which the linking means 4 can be wound and unwound, and an electric motor 7. Periodic oscillations of the water 2 of the pool 1 are obtained by imposing a vertical reciprocating motion to the shell 3 in phase with the waves. The period of the vertical reciprocating motion is determined by experience in a way to excite one of the natural oscillation modes of the mass of water contained in the pool. The amplitude of that reciprocating motion is determined in order to obtain the waves with the desired amplitude.

The shell can be made of a light, cheap, and water-resistant material, such as glassfibre reinforced polyester. One can give various shapes to the shell 3, for example cylindrical or parallelepipedic. An elongated parallelepipedic shape is convenient in a rectangular pool and allows one to obtain various transversal, longitudinal or combined modes of oscillation of the water. A shell 3 with vertical side walls and horizontal bottom favors the transfer of vertical movements to the liquid, and restricts the turbulence created by horizontal movements. In the case the device is used in a fun fair, the shell 3 is made in such a shape that it presents the minimum of risk for the swimmers. The angles of the shell 3 will be rounded.

A control and regulation box 8 can be placed near the motor, or offset in a suitable and accessible place. The box 8 allows the operator to introduce the wanted values of the period of reciprocating motion imposed to the shell 3, and of the amplitude of waves to be generated. The drum 6 contains a sensor 9 which allows measuring its angular position, and to calculate at the same time the height where the shell 3 is suspended and its speed. A locking brake 11 allows maintaining the shell 3 in the raised position when the device is not used. A reducing unit 10 makes the adaptation of the rotational speed of the electric motor 7 to the wanted rotational speed of drum 6. That reducing unit 10 transfers the motor torque to the drum during the lifting of the shell, and allows the drum to run in the reverse direction during descent of the shell.

The shell 3 is advantageously equipped with at least one hole 12 in such a way that the water 2 of the pool may enter into the shell 3. As an option, the shell can be filled at the top. The water contained in the shell 3 gives the whole shell a weight that allows, after being lifted by the winch 5, to fall down again by the action of its apparent weight. The addition of flotation elements 13 allows that the shell, when immersed in the pool, is still able to float. This is not mandatory, and devices in accordance with the invention can be made with non-floating shells. The holes 12 allow one to engage the shell 3 from the outside to move it. They also avoid the excessive movements of the shell 3 relative to the liquid 2.

The position of the shell 3 and the period of the reciprocating motion imposed to it are determined experimentally in a way to excite a natural oscillation mode of the pool 1, in order to obtain the wanted wave shape. The excitation of one of the natural oscillation modes of the pool allows one to get stationary waves, composed by nodes and, ventral segments situated at fixed positions of the pool, without major energy input. The shell 3 is by preference placed in the neighborhood of a ventral segment of the wanted oscillation mode. The movements of a water particle in the neighborhoods of such a ventral segment of the natural oscillation mode of the pool are mainly vertical. The shell preferably contains side walls, in a way that it does not: impose movements to the surrounding water that have a horizontal component, which are not part of wanted oscillations and are thus sources of energy dissipation.

The motor 7 is preferably a direct current, low voltage motor, according to safety regulations applicable to swimming pools. It can also be an alternating current motor or a pneumatic or hydraulic motor. The adjustment of the motor current is made by the control and regulation box 8. The control and regulation box 8 allows determining the desired amplitude of the movement. It contains a regulator unit, for example proportional-integral type, allowing the regulation of the motor current during the lifting period of the shell, to obtain the waves with the desired amplitude. The amplitude of the effectively obtained waves can be calculated from the movements of the shell 3. The shell is indeed moving in a limited way regarding the liquid surface. The movement of the shell 3 is determined by measuring the angular position of the drum.

The control and regulation box 8 can also make the regulation of the pulling and absence of pulling period on the shell. The pulling duration is approximately equal to the time without pulling.

To start a succession of waves, beginning from a flat liquid surface, small pulling forces are applied to the shell 3, then the forces are increased, until obtaining the wanted wave amplitude.

Figure 3:
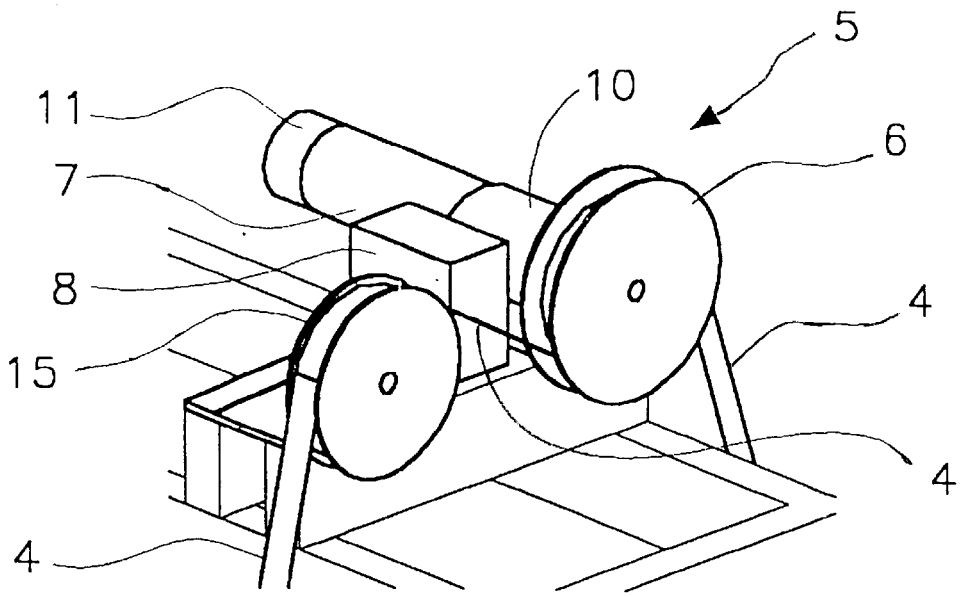
FIG. 3 is a detail of the winch mechanism shown in FIG. 2.
Figure 2:
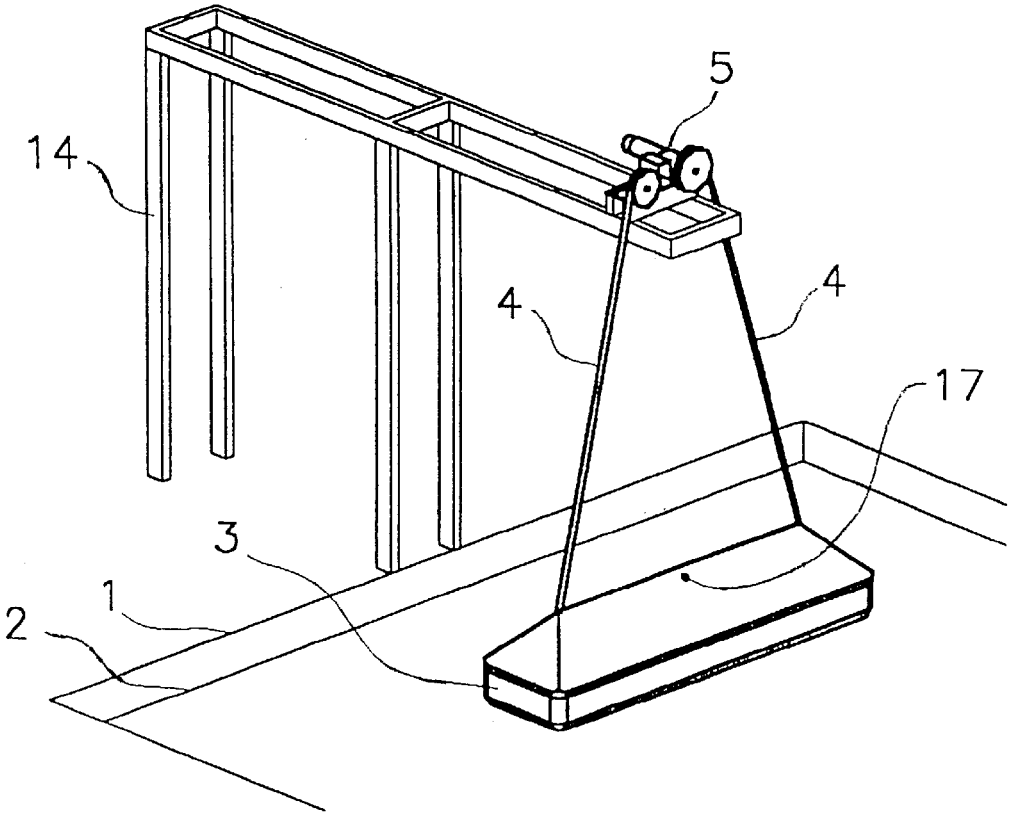
FIG. 2 is a perspective view of a form of embodiment of a device in accordance with the invention.

FIG. 2 shows an example of embodiment of an the invention. A supporting structure 14 allows one to locate the winch 5 above the surface of the pool 1. A structure like that is necessary for outside pools. A fixed diving board can be used as supporting structure 14. When the said structure is designed to be removable, it is easily possible to choose the point of application of the excitation given to the surface of the liquid 2, and to change in that way the shape of the obtained waves. The shell 3 is square shaped. It is 3 m. long and oriented parallel to the short side of the squared pool. The width of the shell 3 is 0,75 m. The weight of the shell is 45 kg. The shell 3 is equipped with a rounded or sharp-pointed protection cover, high enough, to make it for swimmers to grip or sit on it. The linking means 4 is a set of two belts fixed at points located at each side of the protection cover. In such a way, we obtain a good stability of the shell 3. The winch mechanism 5 is specific to that application and represented in FIG. 3. It contains a reversing pulley 15 free to run around a horizontal axis and a drum 6 fixed to the output axis of the electric motor 7 or the reducing unit 10, over which the two belts 4 are rolled, one over the other.

Figures 4, 5, 6:
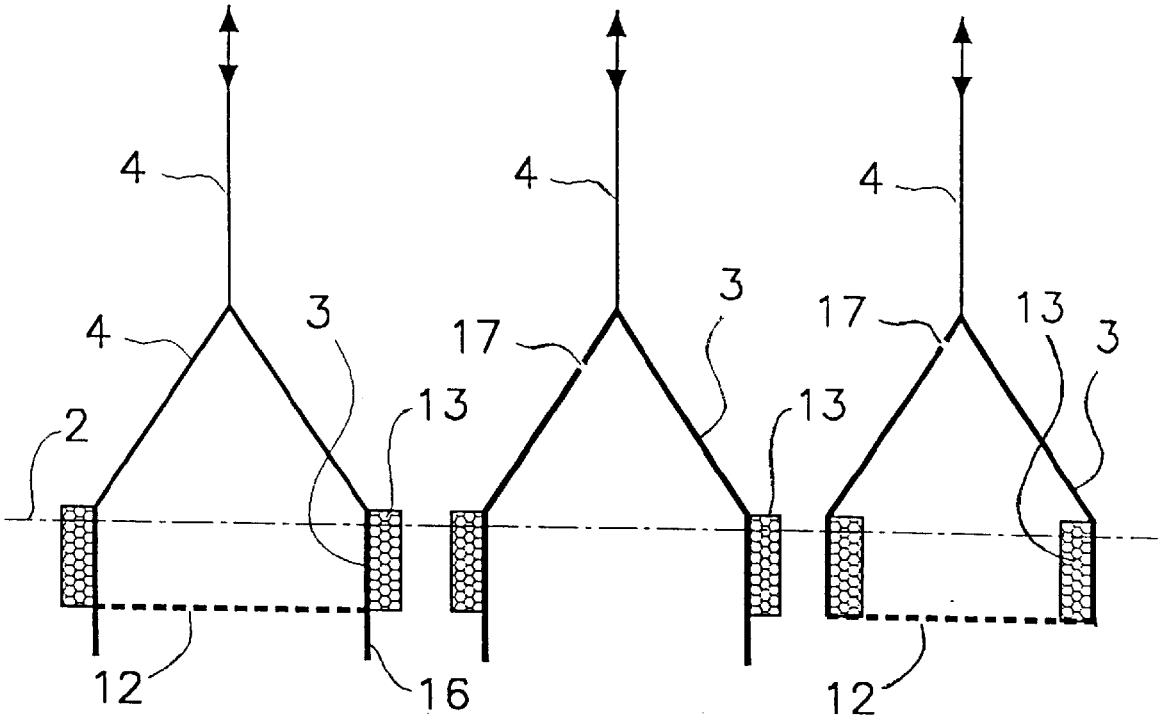
FIGS. 4, 5 and 6 are section views of the three versions of the shell of a device in accordance with the invention.

FIGS. 4, 5 and 6 show various versions of the shell of a device in accordance with the invention.

Figure 7:
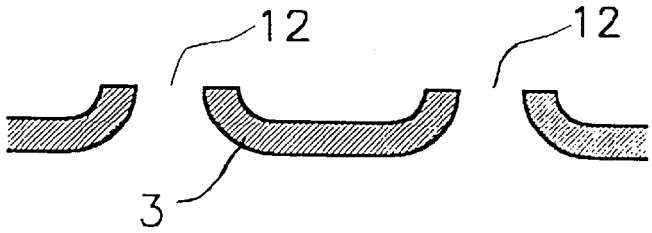
FIG. 7 is a detailed section view of the bottom-perforated version of the shells shown in FIGS. 4 and 6.

The shell presented in FIG. 4 contains several holes 12 in its horizontal bottom side. In a preferred version, these holes have a design as shown in FIG. 7, that favors the penetration of water into the shell during its falling, and disfavor the exit of water during its lifting. In that way, the water level in the shell 3, which varies during its reciprocating motion, is stabilized to a level higher than what it would be without that kind of design. As a result the shell is, in average value, more deeply settled in the water. That allows to apply a bigger pulling force to the shell, without risk of the shell leaving the water. The side walls of the shell 3 are extended by the center boards 16. These increase the vacuum effect during the rising movement.

Figure 8:
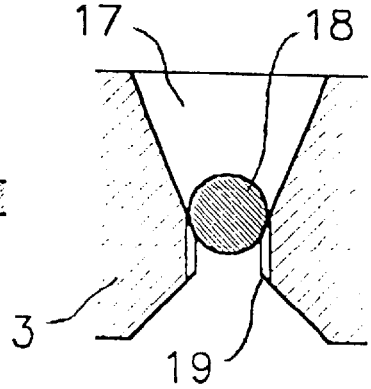
FIG. 8 is a detailed section view of an alternate shell opening shown in FIGS. 5 and 6.

The shell shown in FIG. 5 has no bottom side, but it has a dish cover shape, open at the bottom and closed at the top. The top part of that dish cover contains one or several air flow apertures 17. In a preferred version, air flow apertures 17 are equipped with a valve shown in FIG. 8. In the valve, a blocking ball 18 raises and allows the exit of air during the falling of the shell. During the rising of the shell, the said ball sits on its seat. This seat is equipped with grooves 19, in a way that some air flow is still admitted during the raising of the shell 3. In a similar way to the above mentioned explanation, this favors the exit of air and the penetration of water into the shell during its falling, and disfavors air penetration and water exit during its raising. As a consequence, the water level in the shell 3, which varies during its reciprocating motion, is stabilized to a level higher than what it would be without that kind of valve. As a result, the same shell 3 is, in average value, more deeply settled in the water. That also one to apply a bigger pulling force to the shell, with no risk of extracting it from the water.

FIG. 6 shows a shell 3 having both of the characteristics of the shells shown in FIGS. 4 and 5, which are a perforated bottom, and a dish cover shaped top. For security reasons, in that example, the center boards were removed.

The embodiment forms described above with reference to the figures are not limiting examples of a device in accordance with the invention.

The device in accordance with the invention can easily be installed in an existing pool, without modifying the structure of the pool. In the case of a covered pool 1, the winch 5 and its control box can be fixed to the ceiling of the pool. As a modification, one or more reversing pulleys allow installing the control box at the edge of the pool 1, or in a neighboring room. In the case of an uncovered outside pool, a structure 14 containing a pole allows one to suspend the shell 3 at an appropriate point of the pool 1.

What is claimed is:

1. A device for producing waves in a body of water comprising:

a single hollow shell having substantially vertical side walls, said shell being at least partially filled with water, means suspending said shell in said body of water with said side walls being laterally unrestrained, means for vertically moving the shell periodically upwards and downwards within the body of water to produce waves in said body of water, said shell having an opening through which water can enter the shell when the shell is moved downwards within the body of water and from which the water can exit the shell when the shell is moved upwards within the body of water, said means for vertically moving the shell periodically comprising a drive means for developing an upward force to raise the shell within the body of water, said suspending means comprising a flexible linking means connecting the drive means and said shell.

2. A device as claimed in claim 1, wherein said shell has a horizontal bottom wall connected to said vertical side walls.

3. A device as claimed in claim 2, wherein said shell has a rectangular shape.

4. A device as claimed in claim 1, wherein said opening is in the form of at least one hole in said shell.

5. A device as claimed in claim 1, wherein said shell has a horizontal bottom wall connected to said vertical side walls, said opening being in the form of a plurality of holes in said bottom wall.

6. A device as claimed in claim 5, wherein said holes are so formed in said bottom wall to favor entry of water into the shell and resist exit of the water from said shell.

7. A device as claimed in claim 1, wherein said shell includes an upper dish-shaped cover having an air flow aperture therein.

8. A device as claimed in claim 7, comprising valve means in said air flow aperture which favors air flow out of said shell and resists air flow into said shell.

9. A device as claimed in claim 8, wherein said valve means comprises a gravity-operating ball valve at said aperture.

10. A device as claimed in claim 1, wherein said drive means comprises a winch including a drum on which said flexible linking means can be wound and unwound.

11. A device as claimed in claim 10, wherein said drive means further comprising a regulator box connected for controlling winding and unwinding of said flexible linking means on said drum.

12. A device as claimed in claim 11, wherein said drive means comprises a motor, said regulating box controlling a period of winding and unwinding of said flexible linking means and an output torque of said motor.

13. A device as claimed in claim 1, wherein said flexible linking means comprises a flexible member by which said shell is suspended vertically.

14. A device as claimed in claim 1, wherein said drive means imposes vertical oscillating movement of said shell within said body of water to produce a standing wave of said water with nodal and ventral portions, said shell being positioned at a ventral portion of the standing wave.

15. A device as claimed in claim 14, wherein said body of water is in a swimming pool of rectangular shape, said shell being rectangular and having a long side positioned substantially parallel to a short side of the rectangular shape swimming pool.

16. A device as claimed in claim 1, further comprising a movable structure supporting said shell and said drive means.

17. A device as claimed in claim 1, wherein said means for vertically moving the shell is operated periodically to produce a standing wave at the surface of the body of water.

18. A process for producing waves in a body of water comprising:

providing a single hollow shell having substantially vertical sidewalls and a hole through which water can enter into and exit from the shell, suspending said hollow shell within the body of water for vertical movement within the body of water without lateral restraint of the shell, the shell being at least partially filled with water when immersed in said body of water, periodically moving said shell upwards and downwards within the body of water to produce waves at the surface of the body of water, allowing water to enter the shell through said opening when said shell moves downwards and to exit from said shell when said shell moves upwards, said shell being suspended in the body of water by a flexible member wound on a drum driven by a motor, driving said motor with a torque to wind the flexible member on the drum to move the shell upwards within said body of water, and reducing the torque of the motor to permit the shell to move downwards within said body of water while maintaining said flexible member in tension, and producing said waves at the surface of the water by said upwards and downwards movement of said shell, said standing waves having nodal and vertical portions, said shell being positioned at a ventral portion of the standing waves.

19. A process as claimed in claim 18, wherein said waves are standing waves having nodal and ventral portions, said shell being positioned at a ventral portion of the standing waves.

20. A process as claimed in claim 18, comprising increasing amplitude of said standing waves by increasing torque of said motor.

21. A process as claimed in claim 18, comprising controlling said motor by a regulator box to control torque applied to said drum and periods of upwards and downwards movement of said shell.

* * * * *

UNITED STATES PATENT AND TRADEMARK OFFICE

CERTIFICATE OF CORRECTION

PATENT NO. : 6,217,256 B1
DATED : April 17, 2001
INVENTOR(S) : Mehmet Zahit Inan It is certified that error appears in the above-identified patent and that said Letters Patent is hereby corrected as shown below:

Title page,
Item [63], "PCT/BE98/00304" should read -- PCT/BE98/00046 -- and "April 3" should read -- April 2 --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*